US009476230B2

(12) United States Patent
Margheritti

(10) Patent No.: US 9,476,230 B2
(45) Date of Patent: Oct. 25, 2016

(54) ELECTRICAL VEHICLE LATCH

(71) Applicant: Enrico Margheritti, Lucca (IT)

(72) Inventor: Enrico Margheritti, Lucca (IT)

(73) Assignee: Magna Closures S.p.A., Livorono (IT)

( * ) Notice: Subject to any disclaimer, the term of this patent is extended or adjusted under 35 U.S.C. 154(b) by 0 days.

(21) Appl. No.: 13/864,603

(22) Filed: Apr. 17, 2013

(65) Prior Publication Data

US 2013/0300133 A1 Nov. 14, 2013

(30) Foreign Application Priority Data

Apr. 17, 2012 (EP) ..... 12164511

(51) Int. Cl.

| | |
|---|---|
| ***E05C 3/06*** | (2006.01) |
| ***E05B 81/06*** | (2014.01) |
| ***E05B 77/34*** | (2014.01) |
| ***E05B 81/14*** | (2014.01) |
| ***E05B 81/90*** | (2014.01) |
| *E05B 77/16* | (2014.01) |

(52) U.S. Cl.

CPC ..... *E05B 81/06* (2013.01); *E05B 77/34* (2013.01); *E05B 81/14* (2013.01); *E05B 81/90* (2013.01); *E05B 77/16* (2013.01); *Y10T 292/0945* (2015.04); *Y10T 292/0949* (2015.04)

(58) Field of Classification Search

CPC ..... E05B 81/90; E05B 81/06; E05B 81/14; E05B 77/16; E05B 77/34; Y10T 292/0945; Y10T 292/0949

USPC ..... 292/100, 216, 201, DIG. 23

See application file for complete search history.

(56) References Cited

U.S. PATENT DOCUMENTS

| | | | | | |
|---|---|---|---|---|---|
| 4,634,156 | A * | 1/1987 | Shimura et al. | ..... | 292/216 |
| 5,074,603 | A * | 12/1991 | Brackmann | ..... | 292/216 |
| 5,277,461 | A * | 1/1994 | Dzurko et al. | ..... | 292/216 |
| 5,454,608 | A * | 10/1995 | Dzurko et al. | ..... | 292/216 |
| 5,537,848 | A * | 7/1996 | Grzanka et al. | ..... | 70/279.1 |
| 5,634,677 | A * | 6/1997 | Buscher et al. | ..... | 292/216 |
| 5,667,263 | A * | 9/1997 | Kleefeldt et al. | ..... | 292/336.3 |
| 5,896,767 | A * | 4/1999 | Gomi | ..... | 70/237 |
| 5,961,164 | A * | 10/1999 | Gomi | ..... | 292/216 |
| 6,494,506 | B1 * | 12/2002 | Gleason et al. | ..... | 292/216 |
| 6,511,106 | B2 * | 1/2003 | Perkins et al. | ..... | 292/216 |
| 6,517,128 | B2 * | 2/2003 | Perkins et al. | ..... | 292/216 |
| 6,540,271 | B1 * | 4/2003 | Kalsi | ..... | 292/216 |
| 6,719,333 | B2 * | 4/2004 | Rice et al. | ..... | 292/216 |
| 7,837,243 | B2 * | 11/2010 | Stiglich | ..... | 292/336.3 |
| 2005/0280265 | A1 * | 12/2005 | Iliescu et al. | ..... | 292/216 |

* cited by examiner

*Primary Examiner* — Kristina Fulton
*Assistant Examiner* — Christine M Mills
(74) *Attorney, Agent, or Firm* — Miller Canfield

(57) ABSTRACT

A vehicle latch (1) comprising a ratchet (15); a primary pawl (25) movable between a ratchet checking position and a ratchet release position; an auxiliary ratchet (26) movable between an enabling position and a disabling position; a secondary pawl (27) movable between an auxiliary ratchet holding position, in which the secondary pawl (27) is positioned to hold the auxiliary ratchet (26) in its enabling position, and an auxiliary ratchet release position; electrically-operated actuator means (6) for moving the secondary pawl (27) to the auxiliary ratchet release position and the auxiliary ratchet (26) to the enabling position; a back-up mechanism (7) for moving the secondary pawl (27) to the auxiliary ratchet release position or the auxiliary ratchet (26) to the enabling position; and an inhibiting lever (81) for selectively preventing interaction of the back-up mechanism (7) with the auxiliary ratchet (26).

9 Claims, 10 Drawing Sheets

ELECTRICAL VEHICLE LATCH

RELATED APPLICATIONS

This application claims priority to and all the benefits of European Patent Application No. 12164511.3, filed Apr. 17, 2012 and entitled "An Electrical Vehicle Latch".

BACKGROUND OF THE INVENTION

1. Field of the Invention

The present invention relates to an electrical latch for a vehicle door, in particular of the type utilizing a double pawl arrangement.

2. Brief Description of Related Art

As it is known, one of the defining characteristics of an electrical door latch is that it does not have mechanical linkages to outside and inside door handles. Instead, the door is released by an actuator in response to an electric signal coming from the handles.

Electrical door latches using double pawl arrangements normally comprise:

- a ratchet biased by a spring into a release position, wherein the ratchet is positioned to receive or release a striker fixed to a door post, and which can be moved to a partially locked or first-click position and a fully locked or second-click position, in which the striker is increasingly retained inside the ratchet and prevented from withdrawing;
- a primary pawl movable between a ratchet checking position, wherein the primary pawl is positioned to keep the ratchet in the partially locked or fully locked positions, and a ratchet release position, wherein the primary pawl permits the movement of the ratchet out of the partially locked or fully locked positions;
- an auxiliary ratchet operatively connected to the primary pawl and movable between an enabling position, in which the primary pawl is enabled to move to its ratchet checking position, and a disabling position, in which the auxiliary ratchet positions the primary pawl to its ratchet release position;
- a secondary pawl movable between an auxiliary ratchet holding position, in which the secondary pawl is positioned to hold the auxiliary ratchet in its enabling position, and an auxiliary ratchet release position, in which the secondary pawl is positioned to permit movement of the auxiliary ratchet to its disabling position; and
- an electrically-operated actuator which can be selectively activated for moving the secondary pawl to the auxiliary ratchet release position and the auxiliary ratchet to the enabling position.

The double pawl arrangement consists in establishing a connection of a first set formed by the ratchet and the primary pawl with a second set formed by the auxiliary ratchet and the secondary pawl.

The connection is configured such that only a portion of the forces experienced by the first set are applied to the second set, thus requiring only a relatively low effort to release the latch.

In case of failure of the actuator or in case no energy were available in the vehicle, the known electrical latches may be normally opened by inside and outside emergency release mechanisms (which can be also indicated as inside and outside back-up mechanisms).

Both these mechanisms can be manually operated by the user for releasing the ratchet from the striker.

Known electrical latches can be also provided with an outside emergency lock mechanism for permitting closure of the door even in emergency conditions.

The outside emergency release and lock mechanisms can be activated by acting in opposite directions on the same outside control element, for instance an external key.

During the outside emergency release operation, an action is impressed to the secondary pawl to move it to the auxiliary ratchet release position, so permitting the auxiliary ratchet to reach the disabling position under the action of a spring and to free the primary pawl from the ratchet.

In a different manner, in order to obtain the full lock of the latch from the outside of the vehicle in emergency conditions, an action has to be impressed to the auxiliary ratchet to move it to the enabling position after the ratchet has reached the partially locked position on the striker. This means that it is first necessary to pull the door to the doorpost and then to move the auxiliary ratchet to the enabling position acting on the external key.

In emergency conditions, it is however possible for the user to move the external key in the lock direction when the door is still open; in this hypothetical case, if the key were extracted from the relative seat on the door and put inside the vehicle, an undesired closure of the door would result in the impossibility of reopening it.

SUMMARY OF THE INVENTION

It is an object of the present invention to provide a vehicle latch designed to provide a straightforward, low-cost solution to the above drawback of known latches.

According to the present invention, there is provided a vehicle latch comprising:

- a ratchet movable between a release position, wherein the ratchet is positioned to receive or release a striker, and at least one lock position, wherein the ratchet is positioned to retain the striker;
- a primary pawl movable between a ratchet checking position, wherein the primary pawl is positioned to keep the ratchet in the lock position, and a ratchet release position, wherein the primary pawl permits the movement of the ratchet out of the lock position;
- an auxiliary ratchet operatively connected to the primary pawl and movable between an enabling position, in which the primary pawl is enabled to move to its ratchet checking position, and a disabling position, in which the auxiliary ratchet positions the primary pawl to its ratchet release position;
- a secondary pawl movable between an auxiliary ratchet holding position, in which the secondary pawl is positioned to hold the auxiliary ratchet in its enabling position, and an auxiliary ratchet release position, in which the secondary pawl is positioned to permit movement of the auxiliary ratchet to its disabling position;
- electrically-operated actuator means which can be selectively activated for moving the secondary pawl to the auxiliary ratchet release position and the auxiliary ratchet to the enabling position; and
- a back-up mechanism which can be manually and selectively operated by the user for moving the secondary pawl to the auxiliary ratchet release position or for moving the auxiliary ratchet to the enabling position;

characterized by further comprising an inhibiting lever which, upon movement of the ratchet towards the release position, is set to a disabling condition, in which the inhibiting lever prevents interaction of the back-up mechanism with the auxiliary ratchet.

It is another object of the present invention to provide a vehicle latch designed to minimize the risks that damp may spread to latch electric parts.

According to the present invention, there is also provided a vehicle latch comprising:

a supporting body adapted to be fixed to a vehicle door in a given use position;

a ratchet carried by the supporting body and movable between a release position, wherein the ratchet is positioned to receive or release a fixed striker, and at least one lock position, wherein the ratchet is positioned to retain the striker;

a releasable locking mechanism carried by the supporting body and cooperating with the ratchet to prevent disengagement between the striker and the ratchet; and an electrically-operated release and lock assembly carried by supporting body and which can be activated selectively to free the ratchet from the striker or to lock the ratchet in a condition of engagement with the striker, the release and lock assembly comprising an electric motor;

characterized in that, in the use position of the supporting body, the electric motor is fixed to an upper portion of the supporting body and in a position adjacent to ratchet and higher than the position of the releasable locking means.

BRIEF DESCRIPTION OF THE DRAWINGS

A preferred, non-limiting embodiment of the present invention will be described by way of example with reference to the accompanying drawings, in which.

DETAILED DESCRIPTION OF THE PREFERRED EMBODIMENTS

Number 1 in FIGS. 1 to 4 indicates as a whole an electric latch for a vehicle door (not shown).

Figure 1:
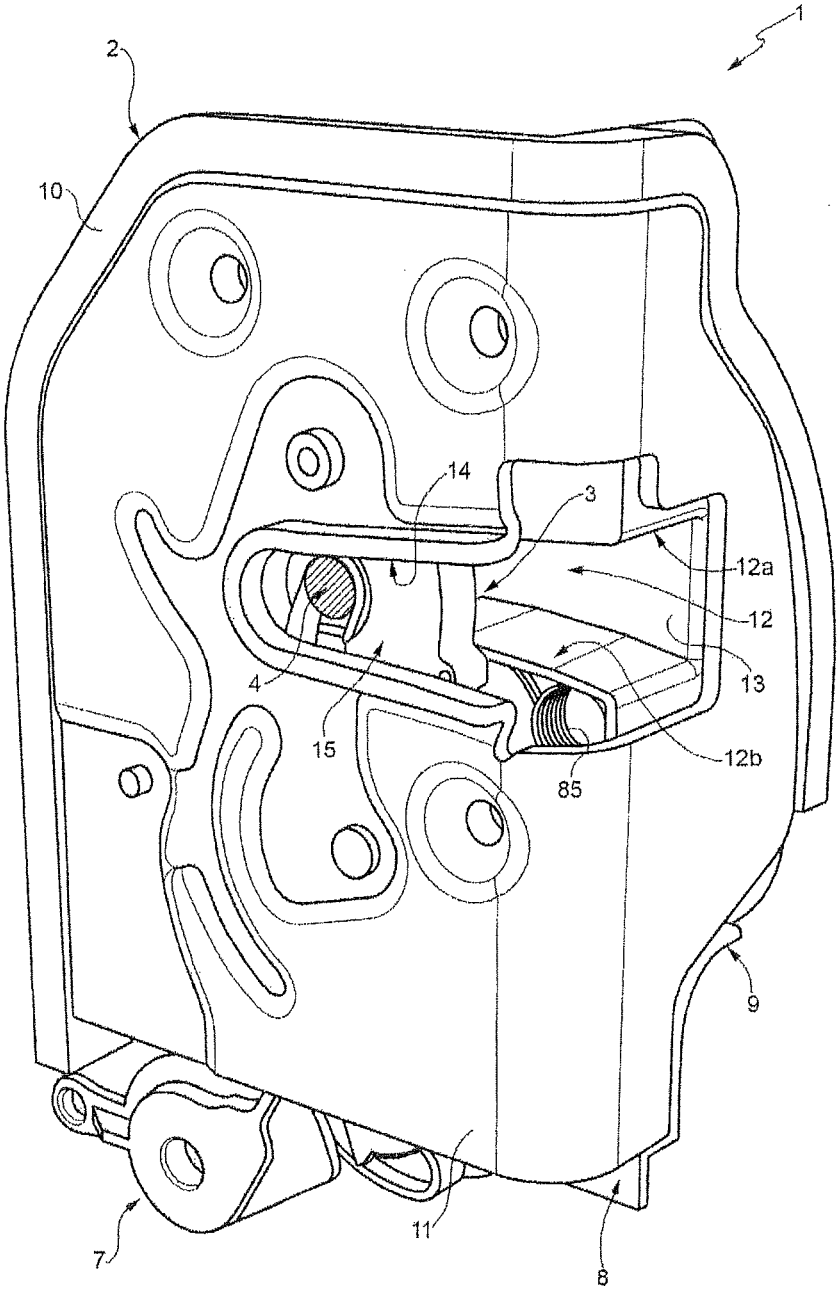
FIG. 1 is a front perspective view of a vehicle latch in accordance with the present invention and in a fully locked position.
Figure 2:
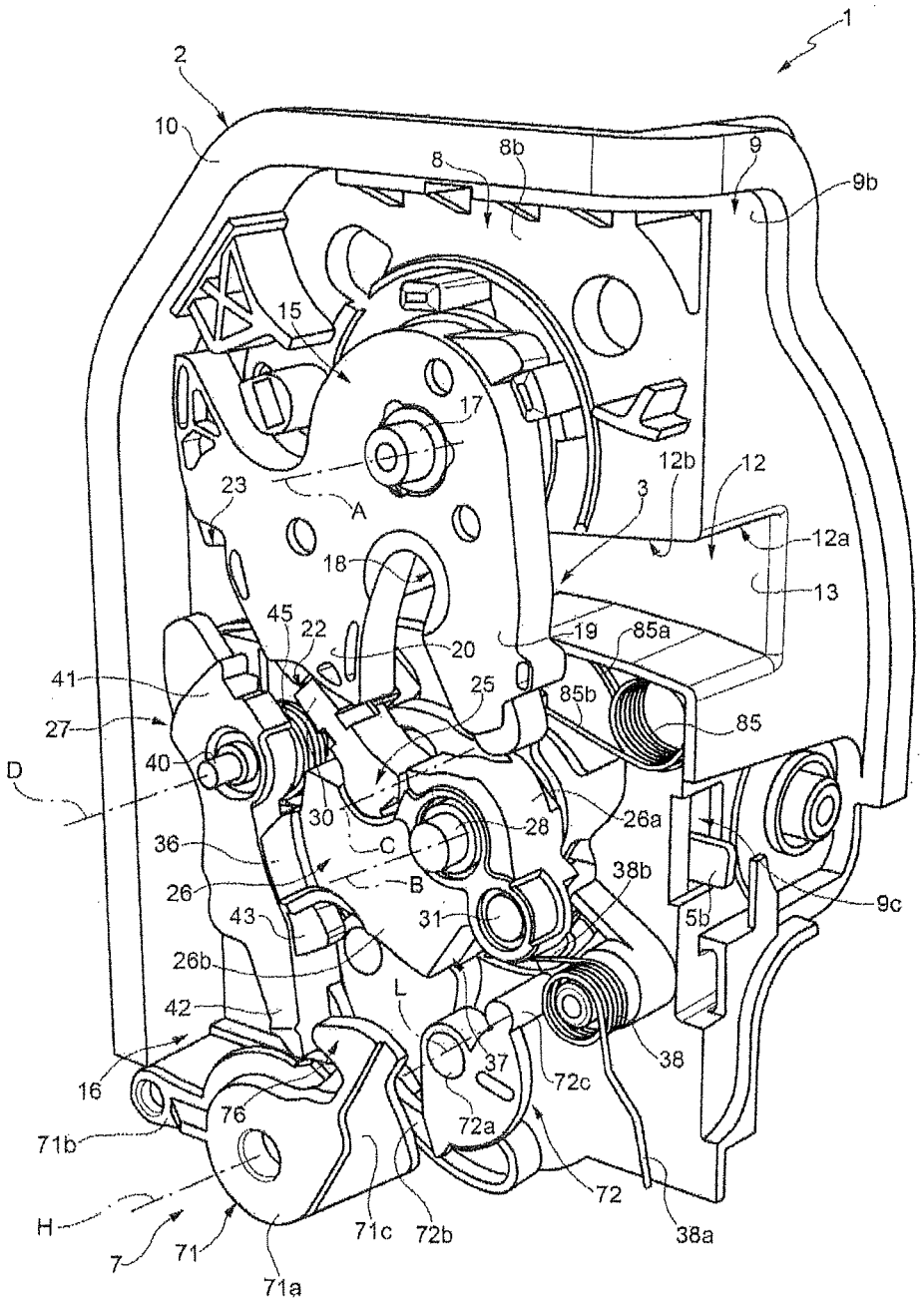
FIG. 2 is the same perspective view of the latch as in FIG. 1 with a front cover removed for clarity.

Latch 1 comprises:

a supporting body 2 fixed, in know manner and in the position of FIGS. 1 and 2, to the vehicle door;

a closure assembly 3 carried by supporting body 2 and adapted to releasably engaging a striker 4 (only partially shown in FIG. 1) integral with a fixed doorpost (not shown);

an electrically-operated release and lock assembly 6 which can be activated selectively to release closure assembly 3 from striker 4 or to lock closure assembly 6 in a condition of engagement with the striker 4;

an inside emergency release lever 5 which can be manually operated by the user from the inside of the vehicle to release the latch 1 in case of failure of the release and lock assembly 6; and a back-up mechanism 7 which can be manually operated by the user from the outside of the vehicle to release or to lock the latch 1 in case of failure of the release and lock assembly 6.

In an alternative embodiment not shown, striker 4 may be fixed to the vehicle door, and supporting body 2, together with latch 1, may be fixed to the doorpost.

With reference to FIGS. 1 to 4, supporting body 2, integrally comprises two plates 8, 9 arranged perpendicularly to each other and extending from a common end edge to define a substantially L-shaped profile when viewed along a plane perpendicular to both plates 8, 9.

Starting from the common end edge, plate 8 has a bigger extent than plate 9.

As visible in FIGS. 1 to 4, each plate 8, 9 is delimited by a first face 8*a*, 9*a* facing the other plate 9, 8, and by an opposite face 8*b*, 9*b*.

Supporting body 2 has a peripheral edge 10 protruding from faces 8*b*, 9*b* of plates 8, 9 except from the portion which is in use positioned inferiorly (FIG. 1).

A front cover 11, having a substantially L-shaped profile, is normally fixed to supporting body 2 in a position, in which it extends parallel to faces 8*b*, 9*b* of both plates 8, 9 and cooperates peripherally with protruding edge 10.

Supporting body 2 defines a C-shaped lateral opening 12 extending along both plates 8 and 9 from the common end edge and adapted to receive striker 4 when closing the door.

Figure 3:
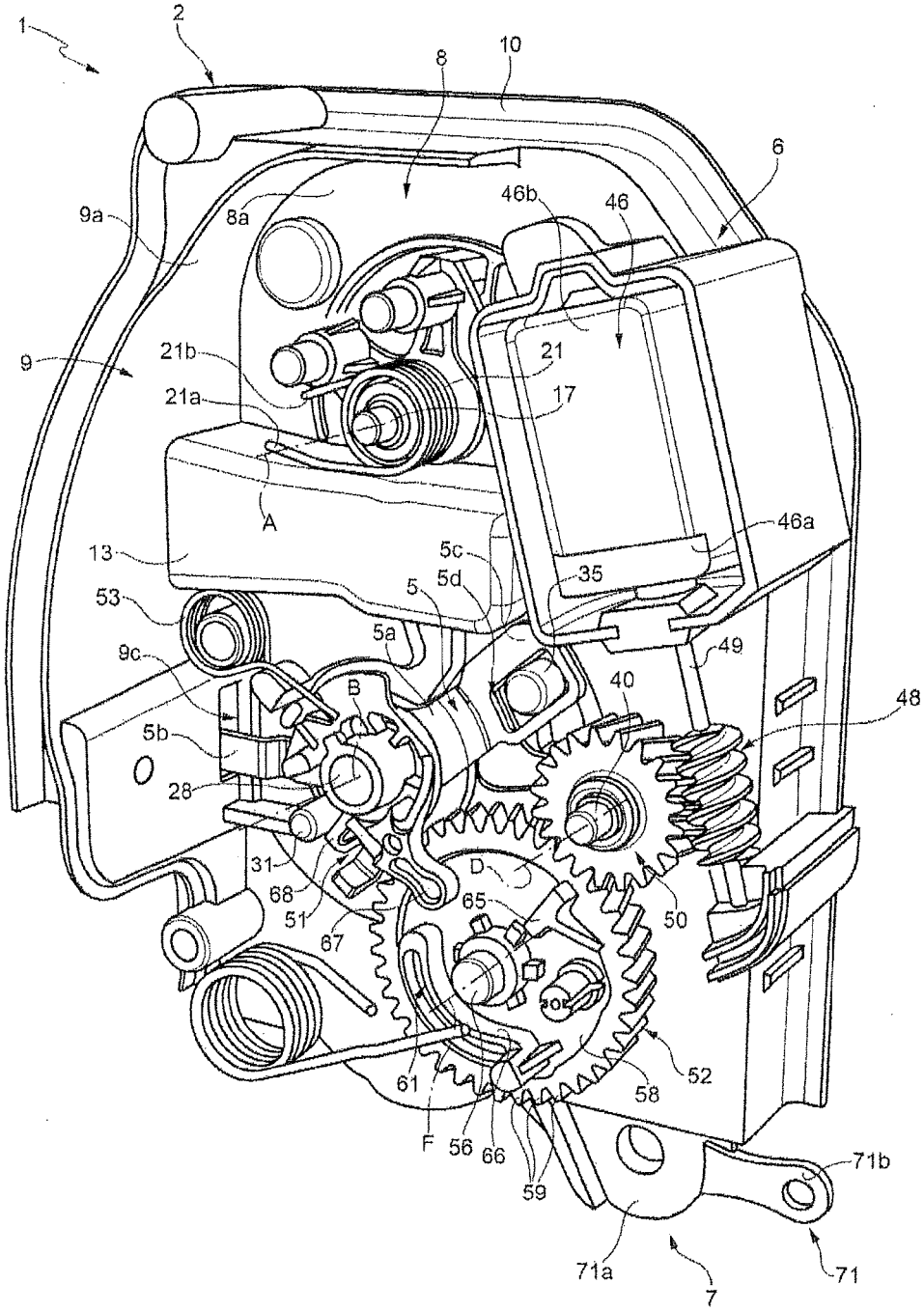
FIG. 3 is a rear perspective view of the latch of FIGS. 1 and 2.
Figure 4:
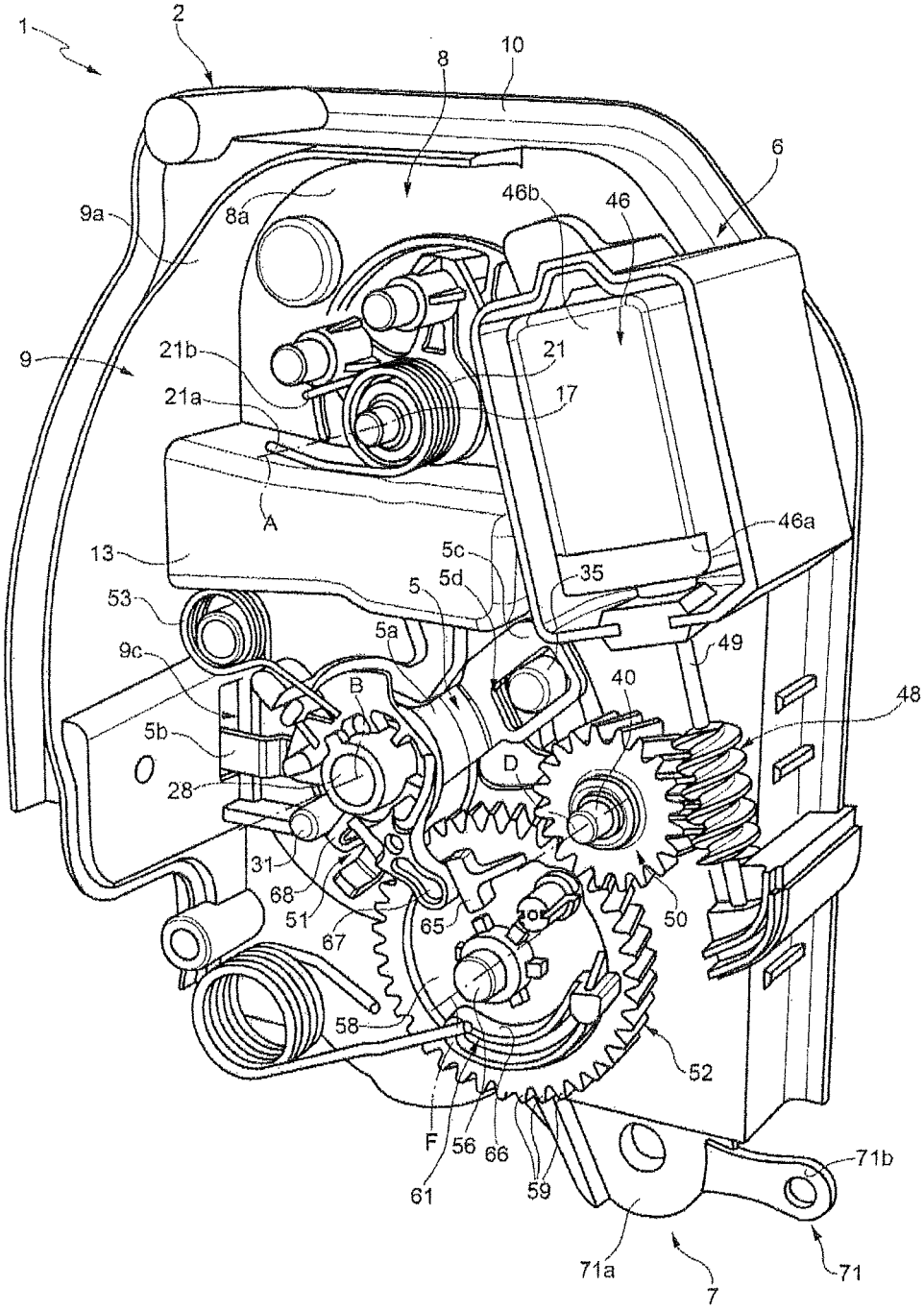
FIG. 4 is the same perspective view of the latch as in FIG. 3 in a partially actuated state of opening.

More specifically, opening 12 comprises a substantially quadrangular inlet portion 12*a* extending through plate 9, and a receiving portion 12*b* extending along plate 8 and closed on the opposite side to the inlet portion 12*a* (FIGS. 1 and 2). As shown in FIGS. 3 and 4, on face 8*a* of plate 8, opening 12 is covered by a casing 13 fixed to both plates 8, 9 and defining a seat for receiving striker 4.

In the example shown, opening 12 and casing 13 are both arranged substantially on an intermediate portion of supporting body 2.

In a completely analogous manner, cover 11 is provided with an opening 14 substantially having the same profile as opening 12 and substantially aligned therewith.

As visible in FIGS. 1 to 4, closure assembly 3 and back-up mechanism 7 are both arranged on face 8*b* of plate 8 so being housed in the gap between supporting body 2 and cover 11, whilst release and lock assembly 6 and inside emergency release lever 5 are placed on face 8*a* of plate 8.

With reference to FIGS. 1, 2 and 5-10, closure assembly 3 basically comprises a ratchet 15 superimposed on the opening 12 for receiving striker 4, and a releasable locking mechanism 16 cooperating with ratchet 15 to prevent disengagement between the striker 4 and the ratchet 15.

In particular, ratchet 15 is hinged about a fixed pin 17 extending orthogonally through plate 8, protruding from both faces 8*a*, 8*b* of the plate 8 and having an axis A. More specifically, ratchet 15 is defined by a contoured plate hinged at an intermediate portion about pin 17 and having a C-shaped peripheral seat 18 bounded laterally by two teeth 19, 20 and adapted to receive striker 4.

A spring 21, wound about pin 17 on the face 8*a* side of plate 8 (FIGS. 3 and 4), pushes ratchet 15 in known manner into a release position (FIGS. 7 and 8), wherein seat 18 faces the same way as openings 12, 14 in supporting body 2 and cover 11, and so permits engagement and release of striker 4. Spring 21 has one end 21*a* cooperating with casing 13, and an opposite end 21*b* secured to ratchet 15.

When the door is slammed, ratchet 15 is rotated by striker 4 about axis A to lock or click onto locking assembly 16, as explained in detail below, in two different positions: a partially locked or first-click position (not shown), and a fully locked or second-click position (FIGS. 1, 2 and 6), in which striker 4 is locked inside seat 18 and prevented from withdrawing by tooth 19 increasingly closing off receiving portion 12*b* of opening 12. In the orientation of FIGS. 2, 5, 7, 8 and 9, the ratchet 15 will rotate anticlockwise to enter the release position.

In greater detail, in the fully locked position, striker 4 is securely ensconced in seat 18 of ratchet 15 such that the vehicle door is completely closed and door seals (not shown) are compressed. In the partially locked position, striker 4 is loosely secured in seat 18 of ratchet 15 such that the vehicle door is locked but not completely closed against its seals.

As ratchet 15 rotates to click onto locking mechanism 16, the partially locked position is therefore interposed between the release position and the fully locked position.

Figure 5:
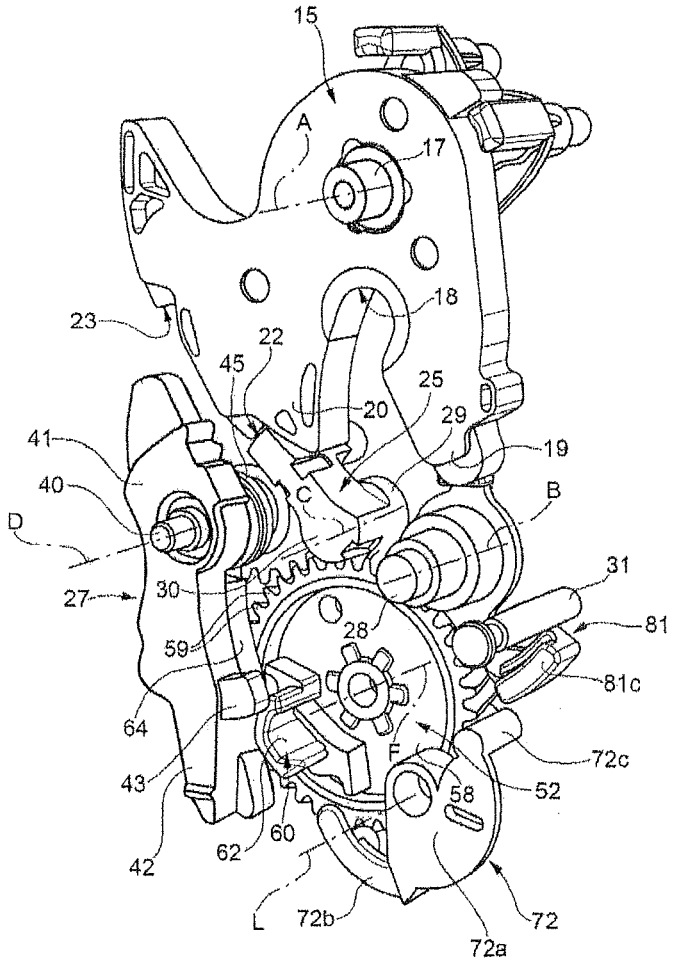
FIG. 5 is the same perspective view of the latch as in FIG. 2 with parts removed for clarity and in the same condition as in FIG. 4.
Figure 8:
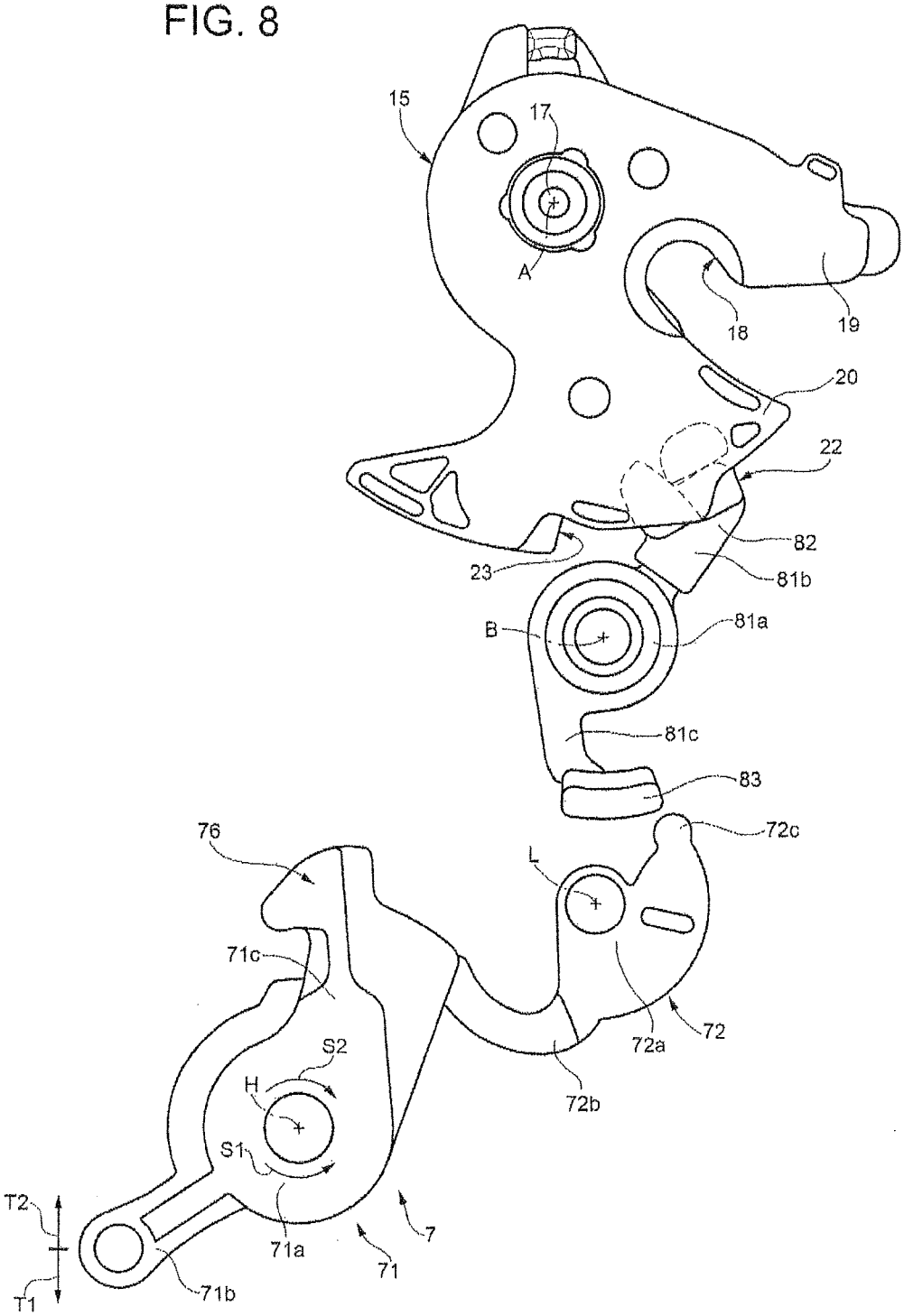
FIG. 8 is the same front view of the latch as in FIG. 7 with some levers removed for clarity.
Figure 9:
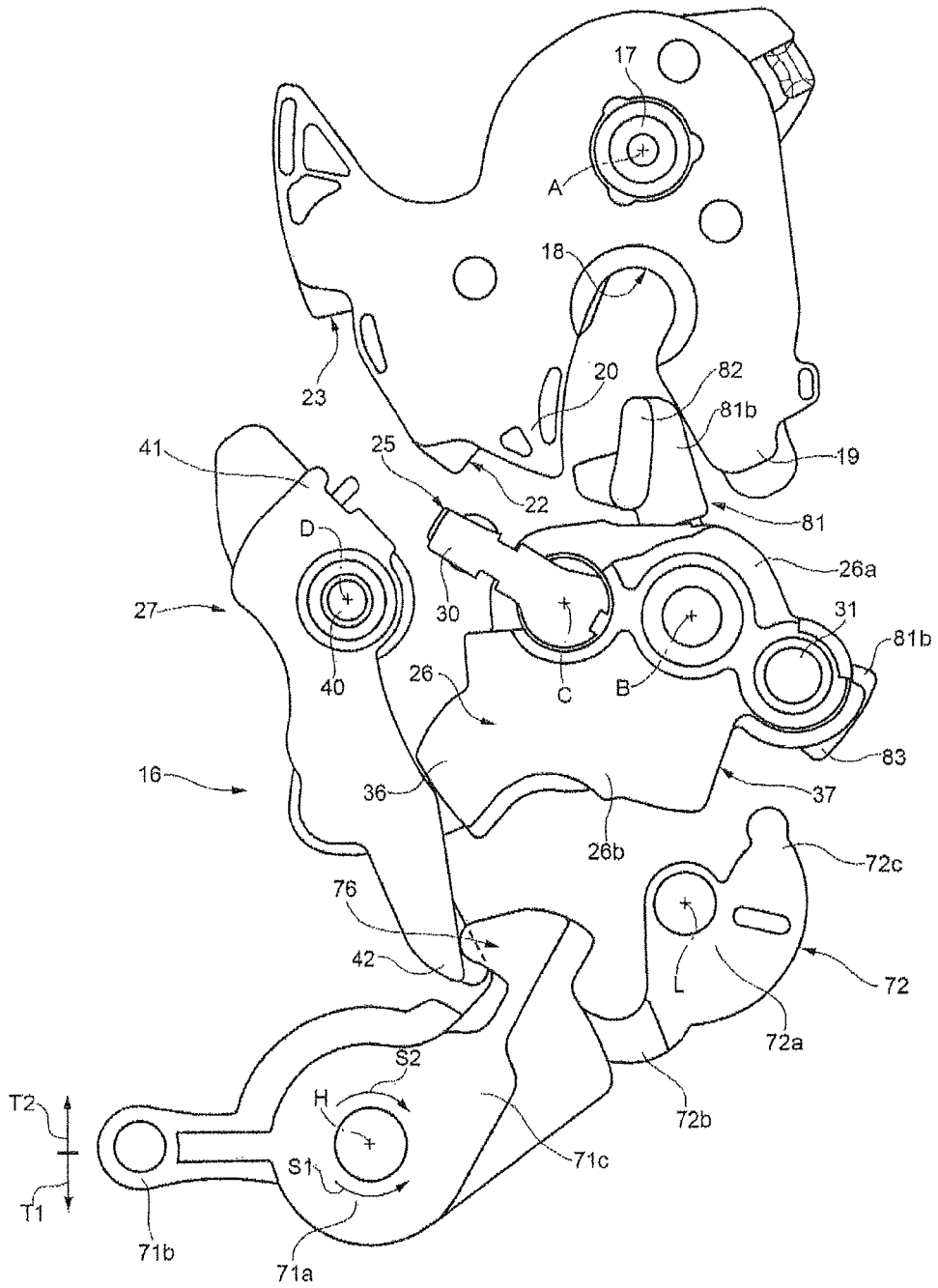
FIG. 9 is the same front view of the latch as in FIG. 7 with some levers removed for clarity and in a partially actuated state of locking the latch.
Figure 10:
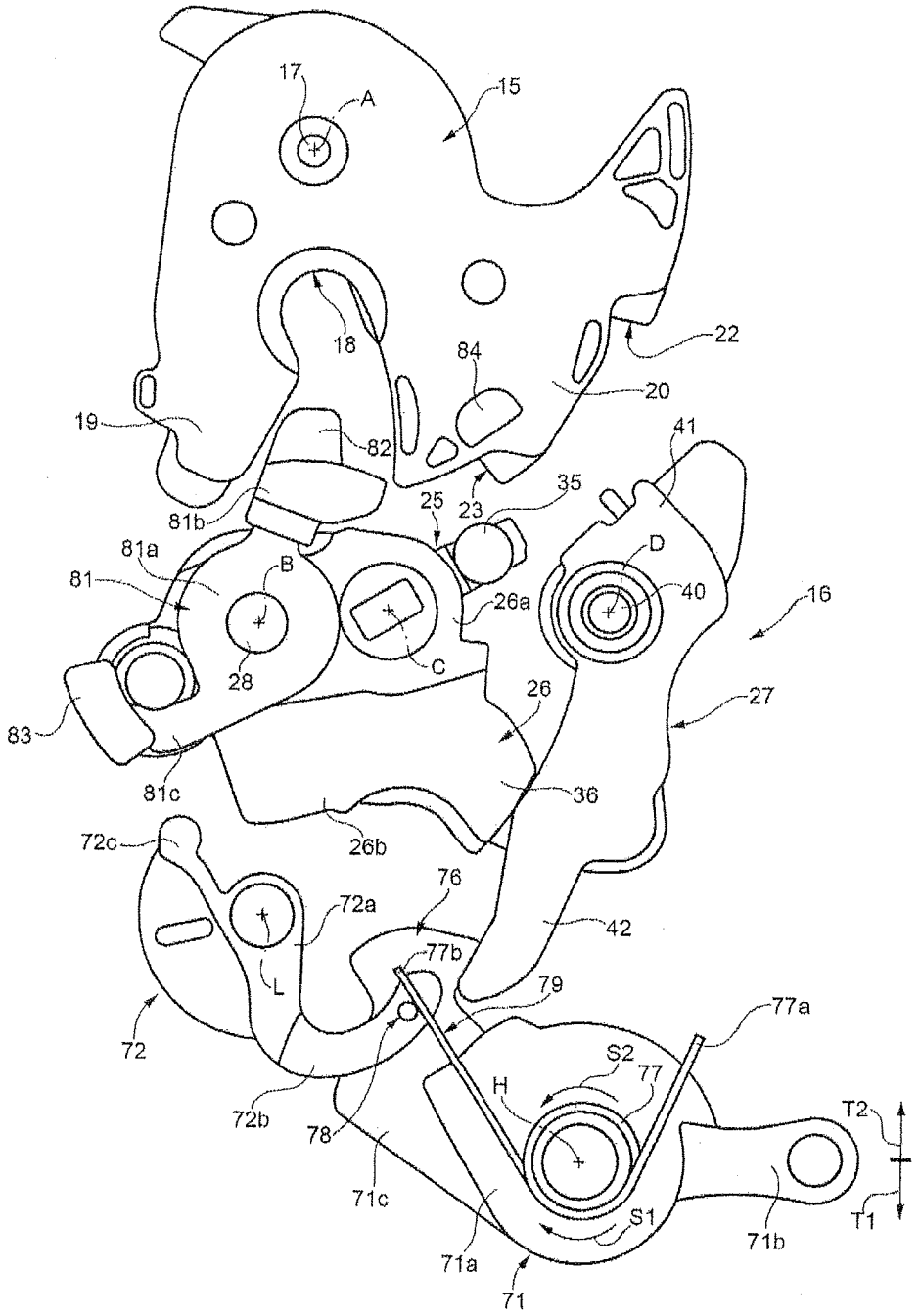
FIG. 10 is a rear view of the latch of FIG. 9.

As visible in FIGS. 2, 5 and 9, the fully locked and partially locked positions are defined by locking mechanism 16 engaging respective shoulders 22, 23 (also visible in FIGS. 7, 8 and 10) formed along the peripheral edge of ratchet 15, on the side delimiting tooth 20 on the opposite side to seat 18.

With reference to FIGS. 2, 7, 9 and 10, locking mechanism 16 is arranged on one side of ratchet 15 and receiving portion 12*b* of opening 12; in the position in which latch 1 is fixed to the vehicle door (FIGS. 1 and 2), locking mechanism 16 is arranged at a lower position than ratchet 15.

With reference to FIGS. 2, 7, 9 and 10, locking mechanism 16 basically comprises:

- a primary pawl 25 movable between a ratchet checking position (FIGS. 2 and 5), wherein the primary pawl 25 is positioned to keep the ratchet 15 in the partially locked position or in the fully locked position, and a ratchet release position (FIG. 7), wherein the primary pawl 25 permits the movement of the ratchet 15 out of the lock position;
- an auxiliary ratchet 26 operatively connected to primary pawl 25 and movable between an enabling position (FIG. 2), in which the primary pawl 25 is enabled to move to its ratchet checking position, and a disabling position (FIGS. 7, 9 and 10), in which the auxiliary ratchet 26 positions the primary pawl 25 to its ratchet release position; and
- a secondary pawl 27 movable between an auxiliary ratchet holding position (FIG. 2), in which the secondary pawl 27 is positioned to hold auxiliary ratchet 26 in its enabling position, and an auxiliary ratchet release position (FIG. 7), in which the secondary pawl 27 is positioned to permit movement of the auxiliary ratchet 26 to its disabling position.

Primary pawl 25, auxiliary ratchet 26 and secondary pawl 27 are all defined by contoured plates substantially extending along the same plane as ratchet 15.

Auxiliary ratchet 26 is hinged about a fixed pin 28 extending orthogonally through plate 8, protruding from both faces 8*a*, 8*b* of the plate 8 and having an axis B parallel to axis A.

Primary pawl 25 is carried by auxiliary ratchet 26 in a rotating manner about an axis C parallel to axis B and spaced therefrom; in particular, primary pawl 25 is carried by auxiliary ratchet 15 on one side of pin 28 and is biased, in a known manner, to the ratchet checking position by a spring (known per se and not shown).

Figure 7:
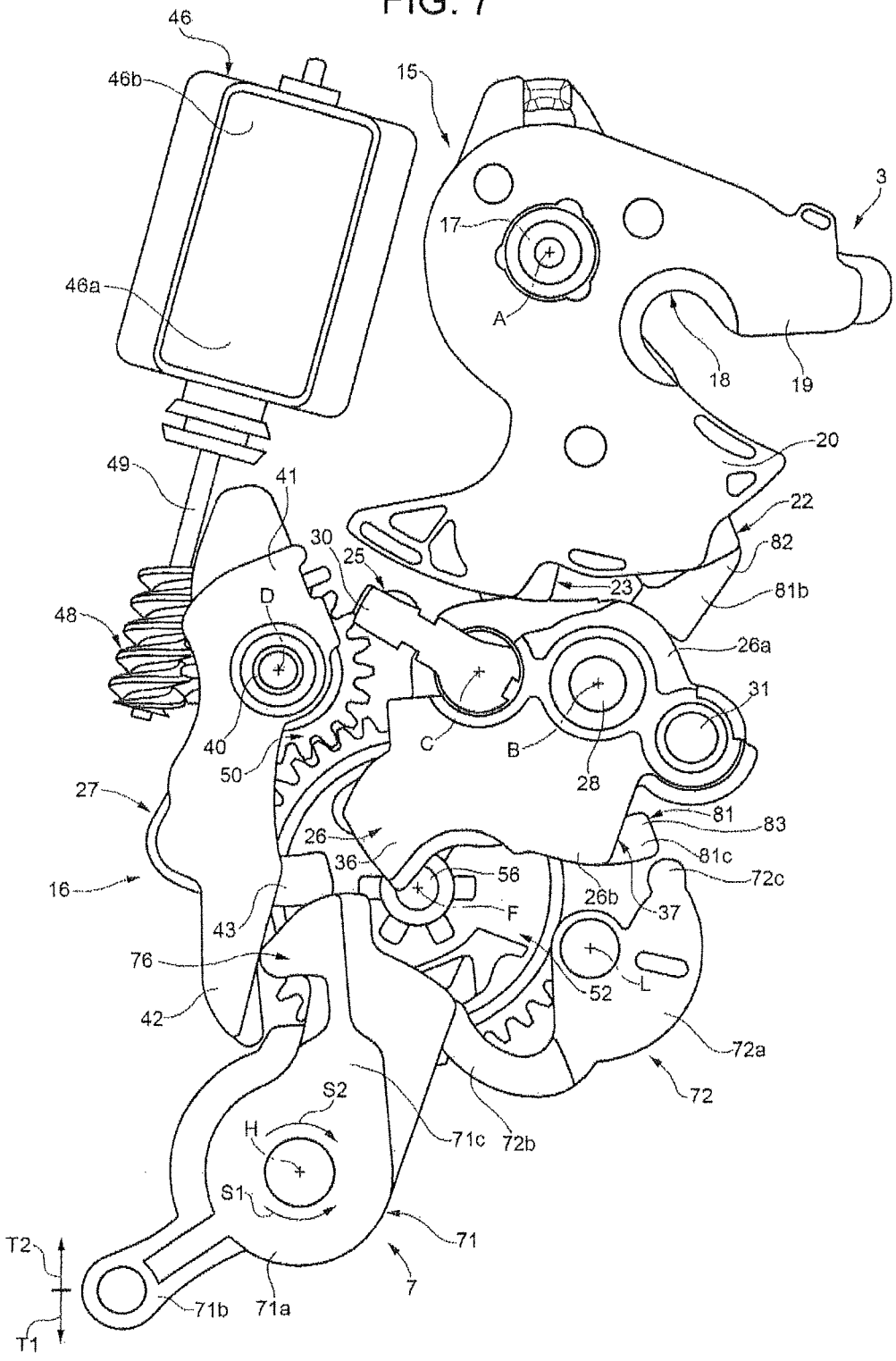
FIG. 7 is a larger-scale front view of the latch of FIG. 2 with parts removed for clarity and in a release position achieved by manually operating a back-up mechanism.

Primary pawl 25 basically comprises a cylindrical stub 29 (FIG. 5) coaxial with axis C and pivotally mounted into a cylindrical bore (not visible) formed on a peripheral portion of auxiliary ratchet 26, and a check arm 30 extending radially from the stub 29 and adapted to pivot between the ratchet checking position, in which the check arm 30 stops the opening urge of the ratchet 15, as shown in FIG. 2, and the ratchet release position, in which the check arm 30 does not inhibit rotation of the ratchet 15 to its release position, as shown in FIGS. 7 and 9. In the orientation of FIGS. 2, 7 and 9, primary pawl 25 will rotate anticlockwise to move into the ratchet release position.

In particular, check arm 30 of primary pawl 25 interacts in use with the shoulders 22, 23 of the ratchet 15 to define the fully locked position and the partially locked position, respectively.

Auxiliary ratchet 26 can rotate about pin 28 between the enabling position, in which the auxiliary ratchet 26 abuts ratchet 15 through primary pawl 25, as shown in FIG. 2, and the disabling position, in which the auxiliary ratchet 26 maintains the primary pawl 25 disengaged from the ratchet 15, as shown in FIGS. 7 and 9. In the orientation of FIGS. 2, 7 and 9, auxiliary ratchet 26 will rotate anticlockwise to enter the disabling position.

Auxiliary ratchet 26 is further provided with a protruding stub 31 arranged on the opposite side of pin 28 with respect to primary pawl 25, extending parallel to pin 28 and engaging a through opening formed in plate 8; as visible in FIGS. 3 and 4, stub 31 has a free end portion projecting from face 8*a* of plate 8 and adapted to receive actuating forces from release and lock assembly 6, as it will be explained in greater detail later on.

As shown in particular in FIGS. 2, 7, 9 and 10, auxiliary ratchet 26 integrally comprises a first upper portion 26*a*, located adjacent to ratchet 15 and which carries primary pawl 25, pin 28 and stub 31, and a second bottom portion 26*b*, located on the opposite part of portion 26*a* with respect to ratchet 15; second bottom portion 26*b* defines, at one side end, a tooth 36 adapted to cooperate in use with secondary pawl 27, and, at the opposite side end and in a position close to stub 31, a lateral edge 37 adapted to cooperate in use with back-up mechanism 7, as it will explained later on.

A spring 38 (FIG. 2), wound about a fixed post extending parallel to pin 28 from face 8*b* of plate 8, biases auxiliary ratchet 26 to the disabling position. Spring 38 has one end 38*a* secured to plate 8, and an opposite end 38*b* cooperating with lateral edge 37 of auxiliary ratchet 26.

With reference to FIGS. 2, 5, 7, 9 and 10, secondary pawl 27 is arranged in a position facing the edge of auxiliary ratchet 26 provided with tooth 36 and is hinged about a fixed pin 40 extending orthogonally through plate 8, protruding from both faces 8*a*, 8*b* of the plate 8 and having an axis D parallel to axes A, B and C. In particular, as clearly visible in FIGS. 7, 9 and 10, pin 40 is arranged on the opposite side of primary pawl 25 with respect to pin 28.

Secondary pawl 27 has an elongated configuration and has one upper portion 41 adjacent to ratchet 15 and hinged to pin 40, and one opposite free end portion 42 adjacent to the edge of supporting body 2 in use positioned inferiorly.

Secondary pawl 27 has an intermediate protruding tooth 43 for engaging tooth 36 of auxiliary ratchet 26.

Secondary pawl 27 is biased towards tooth 36 of auxiliary ratchet 26 by a spring 45 (FIGS. 2 and 5) wound about pin 40 and having one tang (not visible) secured to the plate 8 and one opposite tang (also not visible) cooperating with the secondary pawl 27. In practice, spring 45 pushes secondary pawl 27 towards the auxiliary ratchet holding position.

With reference to FIGS. 3, 4, 6 and 7, release and lock assembly 6 basically comprises an electric motor 46, a worm gear 48 coaxially coupled to a rotating member 49 of motor 46, a first gear wheel 50 meshing with worm gear 48, an actuating lever 51 adapted to interact with stub 31 of auxiliary ratchet 26, and a second gear wheel 52 meshing with gear wheel 50 and adapted to interact with secondary pawl 27 and with actuating lever 51.

In particular, electric motor 46 is fixed to the portion of plate 8 defining the upper part of such plate in the use position (FIGS. 1 to 4). As visible in FIGS. 3 and 4, in the use position, electric motor 46 has a bottom portion 46*a* positioned adjacent to, and facing, the closed side of opening 12 and casing 13, and an upper portion 46*b* extending superiorly with respect to the casing 13; worm gear 48, gear wheels 50, 52 and actuating lever 51 are all arranged inferiorly with respect to casing 13.

It should be noted that, in the use position of supporting body 2, electric motor 46 is arranged in a position adjacent to ratchet 15; in practice, the electric motor 46 and the ratchet 15 are arranged on the supporting body 2 substantially at the same height.

Gear wheel 50 is mounted for rotation about fixed pin 40 of axis D, whilst gear wheel 52 is mounted for rotation about a post 56 having an axis F parallel to axes A, B, C, D and fixed orthogonally to face 8*a* of plate 8. Actuating lever 51 is hinged about fixed pin 28. Gear wheel 52 is functionally interposed between gear wheel 50 and actuating lever 51: this means that gear wheel 52 is driven by gear wheel 50 and drives actuating lever 51.

As clearly shown in FIGS. 3 to 5, gear wheel 52 comprises a discus 58 mounted for rotation about post 56, a plurality of teeth 59 extending along the periphery of the discus 58 and meshing with corresponding teeth of gear wheel 50, and first and second cam means 60, 61 provided on the opposite faces of discus 58 for interacting with secondary pawl 27 and actuating lever 51, respectively.

In particular, with reference to FIG. 5, first cam means 60 comprise a shaped push block 62, which is provided on the face of discus 58 facing face 8*a* of plate 8 and protrudes, through a relative opening of the plate 8, on the other side of the latter for interacting with secondary pawl 27 during an initial part of a release rotational movement (anticlockwise in the orientation of FIGS. 3 and 4) imparted to gear wheel 52 by electric motor 46.

More specifically, push block 62 is adapted to interact with an operative portion 64 (FIG. 5) of secondary pawl 27 arranged below tooth 43, i.e. between tooth 43 and face 8*b* of plate 8, in order to move the secondary pawl 27 to the auxiliary ratchet release position (clockwise about pin 40 in the orientation of FIGS. 1, 2 and 5).

With reference to FIGS. 3 and 4, second cam means 61 comprise two shaped push blocks 65, 66, which protrude in a direction parallel to axis F from the face of discus 58 opposite to the face carrying push block 62, are angularly spaced to one another about the axis F and are adapted to cooperate, along opposite directions, with an arm 67 of actuating lever 51.

In particular, push blocks 65, 66 are substantially located at diametrically opposite positions on discus 50 and have different external configurations.

More specifically, push block 65 is adapted to interact with arm 67 of actuating lever 51 during an ending part of the release rotational movement (anticlockwise in the orientation of FIGS. 3 and 4) imparted to gear wheel 52 by electric motor 46.

Push block 66 is instead adapted to interact with arm 67 of actuating lever 51 during a lock rotational movement (clockwise in the orientation of FIGS. 4 and 6) imparted to gear wheel 52 by electric motor 46 in a direction opposite to the direction of the release rotational movement.

Figure 6:
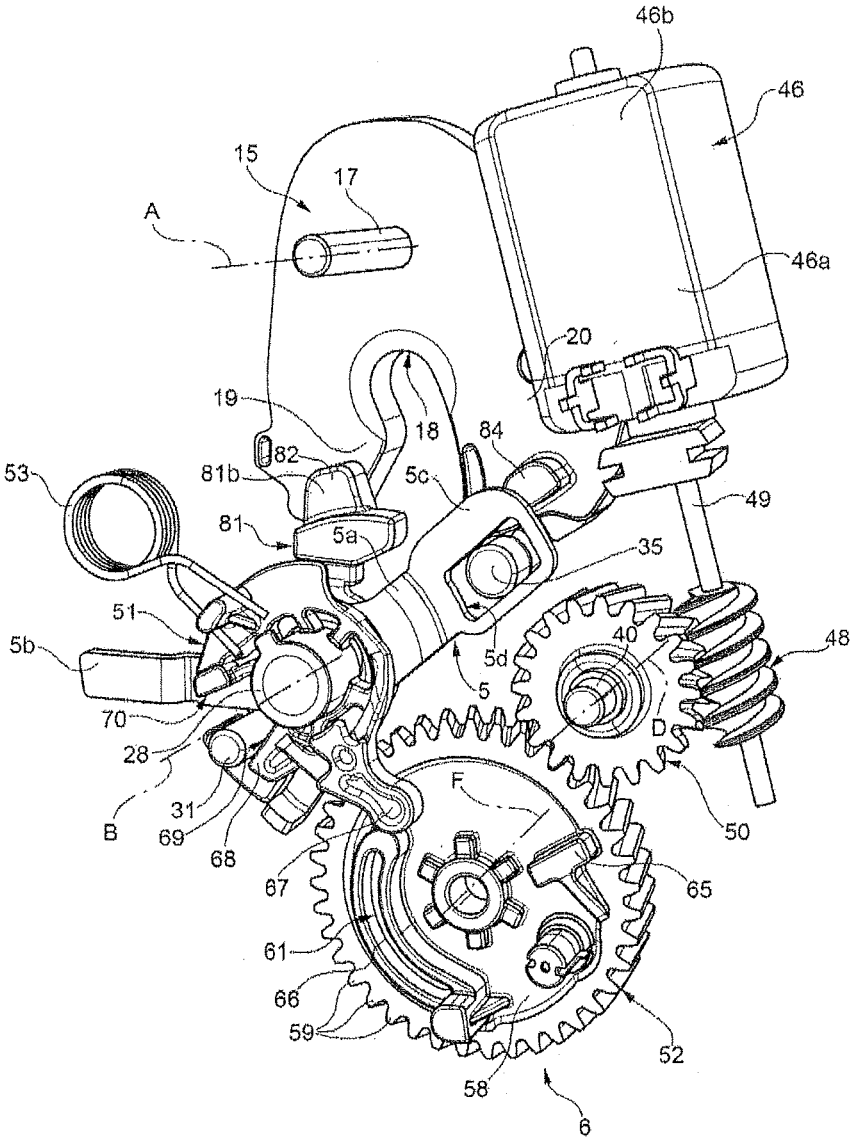
FIG. 6 is the same perspective view of the latch as in FIG. 4 with parts removed for clarity and at the end of a locking operation of the latch.

With particular reference to FIGS. 3, 4 and 6, actuating lever 51 basically comprises the arm 67 and a fork portion 68 angularly spaced from the arm 67 about axis B and defining a seat for receiving the free end portion of stub 31 of auxiliary ratchet 26. In particular, fork portion 68 houses stub 31 with play in an angular direction about axis B. Fork portion 68 is delimited by two opposite push surfaces 69, 70 (FIG. 6) facing one another, arranged on opposite sides of stub 31 and adapted to exert respective pushing actions on the stub 31 during opposite rotational movements of actuating lever 51 about pin 28.

More specifically, upon action of push block 65 on arm 67 during release rotational movement of gear wheel 52, actuating lever 51 is rotated along a first direction (clockwise in FIGS. 3 and 4) about axis B so producing interaction of push surface 69 with stub 31; the result is a rotation of auxiliary ratchet 26 into the disabling position. Due to the fact that auxiliary ratchet 26 is biased by spring 38 to the disabling position when secondary pawl 27 is moved to the auxiliary ratchet release position, the interaction between the push block 65 with the arm 67 only serves to force movement of auxiliary ratchet 26 into such disabling position in case the spring action were insufficient.

In a different manner, upon action of push block 66 on arm 67 during lock rotational movement of gear wheel 52, actuating lever 51 is rotated along a second direction (anticlockwise in FIG. 6) about axis B, opposite to the first direction, so producing interaction of push surface 70 with stub 31; the result is a rotation of auxiliary ratchet 26 into the enabling position.

Actuating lever 51 is biased by a spring 53, wound about a fixed post parallel to pin 28, into a rest position, in which the actuating lever 51 cannot produce any movement of auxiliary ratchet 26.

With reference to FIGS. 3, 4 and 6, inside emergency release lever 5 is of the rocker-type and comprises an intermediate portion 5*a* hinged about fixed pin 28, and two arms 5*b*, 5*c* radially protruding from intermediate portion 5*a* and angularly spaced from one another about axis B.

In particular, arm 5*b* extends with play through an opening 9*c* formed on plate 9 and has a free end externally protruding from the plate 9 and adapted to be connected to a manually-operated transmission device (known per se and not shown), for instance a tie-rod or a Bowden cable transmission, which can be activated by an inside control element (known per se and not shown) provided on the vehicle door.

Arm 5*c* has an end slot 5*d*, which is engaged by a stub 35 orthogonally protruding from a free end of check arm 30 of primary pawl 25 and extending with play through an opening formed on plate 8.

By acting on arm 5*b*, a rotation can be impressed to inside emergency release lever 5 so that arm 5*c* can interact with stub 35 of primary pawl 25 for releasing the primary pawl 25 form ratchet 15 and allowing an emergency opening of the latch 1.

In the example shown in FIGS. 3 and 4, the rotation impressed to inside emergency release lever 5 is in a clockwise direction.

Inside emergency release lever 5 is biased by a spring (known per se and not shown) to a position maintaining primary pawl 25 in the ratchet checking position. With reference to FIGS. 2 and 7 to 10, back-up mechanism 7 is substantially arranged on the opposite side of locking mechanism 16 with respect to ratchet 15; in the position in which latch 1 is fixed to the vehicle door (FIGS. 1 and 2), back-up mechanism 7 is arranged at a lower position than locking mechanism 16.

Back-up mechanism 7 comprises an outside emergency release lever 71, which can be manually operated from the outside of the vehicle for moving secondary pawl 27 into the auxiliary ratchet release position so permitting an emergency opening of latch 1, and an outside emergency lock lever 72, which can be manually operated from the outside of the vehicle for moving auxiliary ratchet 26 into its enabling position so permitting an emergency lock of the latch 1.

Outside emergency release lever 71 is of the rocker-type and comprises an intermediate portion 71*a* hinged about a fixed pin (not shown) extending orthogonally from face 8*b* of plate 8 and having an axis H parallel to axes A to G.

Outside emergency release lever 71 also comprises two arms 71*b*, 71*c* radially protruding from intermediate portion 71*a* and angularly spaced from one another about axis H.

Arm 71*b* has a free end adapted to be connected to a manually-operated transmission device (known per se and not shown), for instance a tie-rod or a Bowden cable transmission, which can be activated by an outside control element (known per se and not shown), for instance an external key.

The free end of arm 71*b* can receive opposite activation forces T1, T2 by the transmission device, resulting in opposite rotations of the outside emergency release lever 71 about axis H. In particular, a first activation force, indicated by arrow T1 in FIGS. 1 to 4 and 7 to 10, produces a rotational movement along a first direction S1 (anticlockwise in FIGS. 7 to 9) of outside emergency release lever 71; in a different manner, a second activation force T2, opposite to activation force T1, produces a rotational movement along a second direction S2 (clockwise in FIGS. 7 to 9) of outside emergency release lever 71, opposite to first direction S1.

Arm 71*c* is provided with first transmission means 76 for interacting with free end portion 42 of secondary pawl 27 as a result of a rotation of outside emergency release lever 71 in direction S1 (or as a result of an action on outside emergency release lever 71 in direction T1), and with second transmission means 79 for interacting with outside emergency lock lever 72 as a result of a rotation of outside emergency release lever 71 in direction S2 (or as a result of an action on outside emergency release lever 71 in direction T2).

In particular, first transmission means 76 are defined by an anvil-shaped end of arm 71*c*; when activation force T1 is applied to the free end of arm 71*b*, outside emergency release lever 71 rotates about axis H in direction S1 so causing interaction of anvil-shaped end of first transmission means 76 with free end portion 42 of secondary pawl 27 and rotation of the latter into the auxiliary ratchet release position.

Outside emergency release lever 71 is biased by a spring 77, wound about the relative pin, into a rest position, in which the outside emergency release lever 71 cannot produce any movement of secondary pawl 27 or outside emergency lock lever 72.

Spring 77 has a first tang 77*a* secured to the body of outside emergency release lever 71 and a second tang 77*b* extending along arm 71*c* (FIG. 10) and cooperating with a receiving portion 78 of outside emergency lock lever 72 to actuate the latter, as it will be explained in greater detail later on.

In particular, tang 77*b* of spring 77 defines second transmission means 79.

Outside emergency lock lever 72 is also of the rocker-type and comprises an intermediate portion 72*a* hinged about a fixed pin (not shown) extending orthogonally from face 8*b* of plate 8 and having an axis L parallel to axes A to H.

Outside emergency lock lever 72 further comprises two arms 72*b*, 72*c* protruding from intermediate portion 72*a* and angularly spaced from one another about axis L.

Arm 72*b* is positioned adjacent to arm 71*c* of outside emergency release lever 71 and has a laterally protruding stub defining the portion 78 cooperating with tang 77*b* of spring 77 of the outside emergency release lever 71.

Arm 72*c* is positioned adjacent to auxiliary ratchet 26 and is adapted to interact with lateral edge 37 of the auxiliary ratchet 26 to move the latter into the enabling position as a result of a rotation of outside emergency lock lever 72 produced by applying activation force T2 on the free end of arm 71*b* of outside emergency release lever 71.

Outside emergency lock lever 72 is biased by a spring (known per se and not shown) into a rest position, in which it is spaced from auxiliary ratchet 26.

With reference to FIGS. 5 and 7 to 10, latch 1 advantageously comprises an inhibiting lever 81 which, upon movement of ratchet 15 towards the release position, is set to a disabling condition (FIGS. 7 and 8), in which the inhibiting lever 81 prevents interaction of back-up mechanism 7 with auxiliary ratchet 26.

In particular, inhibiting lever 81 is of the rocker-type and is interposed between ratchet 15 and outside emergency lock lever 72. Inhibiting lever 81 comprises an intermediate portion 81*a* hinged about pin 28, and two arms 81*b*, 81*c* protruding from intermediate portion 81*a*, angularly spaced from one another about axis B and adapted to interact in use with ratchet 15 and outside emergency lock lever 72, respectively.

More specifically, inhibiting lever 81 substantially extends along a plane parallel to, and interposed between, face 8*b* of plate 8 and the plane of ratchet 15 and auxiliary ratchet 26; in this way, auxiliary ratchet 26 is substantially superimposed over the most part of the body of inhibiting lever 81, and ratchet 15 is substantially superimposed over an end portion 82 of arm 81*b*.

As visible in FIG. 5, arm 81*c* has one end portion 83, which is adapted to be interposed between the lateral edge 37 of the auxiliary ratchet 26 and the arm 72*c* of outside emergency lock lever 72 when the inhibiting lever 81 is in the disabling condition. The end portion 82 of arm 81*b* is instead adapted to interact with a push block 84 protruding from tooth 20 of ratchet 15 towards face 8*b* of plate 8.

Inhibiting lever 81 is biased by a spring 85 into an enabling position (FIGS. 2, 5, 9 and 10), in which the inhibiting lever 81 has the arm 81*c* positioned out of the path followed by arm 72*c* of outside emergency lock lever 72 for acting on lateral edge 37 of auxiliary ratchet 26, and, upon movement of ratchet 15 towards the release position, is pushed to the disabling condition (FIGS. 7 and 8), in which the inhibiting lever 81 maintains the end portion 83 interposed between the lateral edge 37 of the auxiliary ratchet 26 and the arm 72*c* of outside emergency lock lever 72 so preventing any action of the latter on the auxiliary ratchet 26.

In greater detail, push block 84 of ratchet 15 is configured to start to interact with end portion 82 of arm 81*b* of inhibiting lever 81 before the ratchet 15 reaches the partially locked position during the opening of the latch 1 so that, in the partially locked position, the inhibiting lever 81 is already able to prevent any action of the outside emergency lock lever 72 on the auxiliary ratchet 26. More specifically, the push block 84 is configured to maintain the end portion 83 of inhibiting lever 81 in a position interposed between lateral edge 37 of auxiliary ratchet 26 and arm 72*c* of outside emergency lock lever 72, during the entire rotation of the ratchet 15 from the partially locked position to the release position.

At the end of the release movement of ratchet 15, inhibiting lever 81 is set to a final disabling position shown in FIGS. 7 and 8.

Spring 85 is wound about a post (not shown) projecting orthogonally from face 8*b* of plate 8 in a lateral position with respect to arm 81*b* of inhibiting lever 81; spring 85 has a first tang 85*a* secured to plate 8 and a second tang 85*b* cooperating with arm 81*b* of inhibiting lever 81.

In actual use, starting from the closed condition of FIGS. 1 to 3, the latch 1 is released by activating electric motor 46 so as to obtain anticlockwise rotation of gear wheel 52 about axis F (visible by comparing FIGS. 3 and 4). During a first part of this rotation, push block 65 of cam means 61 moves towards arm 67 of actuating lever 51 and push block 60 of cam means 60 (FIG. 5) interacts with operative portion 64 of secondary pawl 27 so moving the secondary pawl 27 into the auxiliary ratchet release position.

Under the thrust of spring 38, auxiliary ratchet 26 is therefore free to rotate about axis B into its disabling position. Should the spring action be insufficient, the interaction of push block 65 of cam means 61 on arm 67 of actuating lever 51 produces the clockwise rotation of the actuating lever 51 about axis B with the consequent interaction of surface 69 of fork portion 68 on stub 31 of auxiliary ratchet 26.

Therefore, the result of the movements imparted by the activation of electric motor 46 is a rotation of auxiliary ratchet 26 into the disabling position. This rotation produces a corresponding rotation of primary pawl 25 about axis C so as to free ratchet 15, which can rotate into the release position (FIGS. 7 and 8) under the thrust of spring 21. In this condition, disengagement between ratchet 15 and striker 4 is made possible.

Immediately after the opening of the latch 1, electric motor 46 is again activated in the opposite direction so as to produce a clockwise rotation of gear wheel 52 with a consequent interaction of push block 66 of cam means 61 with arm 67 of actuating lever 51 (FIG. 6). In this way, surface 70 of fork portion 68 of actuating lever 51 exerts a thrust on stub 31 of auxiliary ratchet 26 to move the auxiliary ratchet 26 into the enabling position. During this rotation, secondary pawl 27, which is biased towards auxiliary ratchet 26 by spring 45, moves to the auxiliary ratchet holding position; in practice, the auxiliary ratchet 26 is retained in its enabling position by engagement of its tooth 36 with the tooth 43 of secondary pawl 27.

When the door is slammed an impact of striker 4 is produced on tooth 20 of ratchet 15 with a consequent clockwise rotation of the ratchet 15 about axis A in opposition to spring 21. As shoulder 22 of ratchet 15 is pushed past primary pawl 25, the latter clicks further towards the ratchet 15 with its free end positioned in front of the shoulder 22; ratchet 15 is thus prevented from being sprung back by spring 21 into the release position by shoulder 22 resting against the free end of the primary pawl 25, and so remains locked in the fully locked position, in which tooth 19 closes off opening 12 of supporting body 2 to prevent withdrawal of striker 4 from opening 12 (FIGS. 1 and 2).

In case of failure of the electric motor 46 or in case in which no energy were available on the vehicle, opening of the latch 1 may be performed by acting on inside emergency release lever 5 from the inside of the vehicle, for instance by manually operating an inside control element, or by acting on the outside emergency release lever 71 from the outside of the vehicle, for instance by an external key.

In the first situation (opening from the inside of the vehicle), by rotating inside emergency release lever 5 about axis B clockwise, arm 5*c* pushes stub 35 in the same direction so freeing primary pawl 25 from engagement with ratchet 15, which can move to the release position under the action of spring 21.

In the second situation (opening from the outside of the vehicle), by applying activation force T1 (FIGS. 9 and 10) on the free end of outside emergency release lever 71, this lever rotates about axis H in direction S1 (anticlockwise in FIG. 9) so causing interaction of the anvil-shaped end of first transmission means 76 with free end portion 42 of secondary pawl 27 and rotation of the latter into the auxiliary ratchet release position (FIG. 7).

Under the thrust of spring 38, auxiliary ratchet 26 is therefore free to rotate about axis B into its disabling position. This rotation produces a corresponding rotation of primary pawl 25 about axis C so as to free ratchet 15, which can rotate into the release position (FIGS. 7 and 8) under the thrust of spring 21.

During its movement about axis A, ratchet 15 interacts with end portion 82 of inhibiting lever 81 through push block 84, so producing a rotation of the inhibiting lever 81 about axis B in opposition to spring 85 and towards the final disabling position (FIGS. 7 and 8). In particular, the push block 84 of ratchet 15 starts to interact with end portion 82 of arm 81*b* of inhibiting lever 81 before the ratchet 15 reaches the partially locked position so that, in the partially locked position, the inhibiting lever 81 is already able to prevent any action of the outside emergency lock lever 72 on the auxiliary ratchet 26 (disabling condition). More specifically, during the entire rotation of the ratchet 15 from the partially locked position to the release position, the push block 84 maintains the end portion 83 of inhibiting lever 81 in a position interposed between lateral edge 37 of auxiliary ratchet 26 and arm 72*c* of outside emergency lock lever 72. The final disabling position of the inhibiting lever 81 is reached when the ratchet 15 is in the release position.

It is evident that in this condition, by applying activation force T2 on the free end of outside emergency release lever 71, so as to rotate outside emergency lock lever 72 about axis L towards the lateral edge 37 of auxiliary ratchet 26, only results in an increased tension on spring 85 without any displacement of the outside emergency lock lever 72, which abuts against end portion 83 of the inhibiting lever 81. As a matter of fact, the rotation of inhibiting lever 81 about axis H in direction S2 tends to produce a corresponding displacement of tang 85*b* of spring 85, which however cannot follow arm 71*c* as stopped by portion 78 of outside emergency lock lever 72 in turn maintained in abutment against end portion 83 of the inhibiting lever 81.

In this way, no undesired strain is produced on the chain formed by outside emergency release lever 71, outside emergency lock lever 72, inhibiting lever 81 and ratchet 15.

Only when ratchet 15 reaches its fully locked position, so producing a detachment of push block 84 from end portion 82, inhibiting lever 81 can return to its enabling position under the thrust of spring 85. In this condition, a rotation of outside emergency release lever 71 in direction S2 produces the interaction of outside emergency lock lever 72 with the lateral edge 37 of auxiliary ratchet 26 so causing the movement of the latter into the enabling position and a corresponding lock of the latch 1.

It is clear from the foregoing that inhibiting lever 81 permits to avoid any undesired displacement of the auxiliary ratchet 26 in the disabling position when the door is open, which, upon a subsequent accidental closure of the door with the key inside the vehicle, could result in the impossibility to open again the door.

Moreover, the particular layout of the latch 1, with electric motor 46 placed on the upper portion of supporting body 2, permits to minimize the risks that damp possibly entering the latch 1 through opening 12 may spread to the electric motor 46.

Clearly, changes may be made to the vehicle latch 1 as described and illustrated herein without, however, departing from the scope as defined in the accompanying claims.

The invention claimed is:

1. A vehicle latch (1) comprising:

a ratchet (15) movable between a release position, wherein the ratchet (15) is positioned to receive or release a striker (4), and at least one lock position, wherein the ratchet (15) is positioned to retain said striker (4);

a releasable locking mechanism (16) cooperating with said ratchet (15) for actuating said ratchet (15) between the release position and the at least one lock position, said releasable locking mechanism including a primary pawl (25) movable between a ratchet checking position, wherein the primary pawl (25) is positioned to engage and keep said ratchet (15) in the at least one lock position, and a ratchet release position, wherein the primary pawl (25) permits the movement of said ratchet (15) out of said at least one lock position, an auxiliary ratchet (26) operatively connected to said primary pawl (25) and movable between an enabling position, in which the primary pawl (25) is enabled to move to said ratchet checking position, and a disabling position, in which the auxiliary ratchet (26) positions the primary pawl (25) to said ratchet release position, and a secondary pawl (27) movable between an auxiliary ratchet holding position, in which the secondary pawl (27) is positioned to hold said auxiliary ratchet (26) in said enabling position, and an auxiliary ratchet release position, in which the secondary pawl (27) is positioned to permit movement of said auxiliary ratchet (26) to said disabling position;

an electrically-operated actuator (6) for engaging and automatically moving said secondary pawl (27) to said auxiliary ratchet release position and said auxiliary ratchet (26) to said enabling position;

an inside emergency release lever (5) for manually moving said primary pawl to said ratchet release position independent of said electrically-operated actuator (6); and a back-up mechanism (7) for manually actuating said locking mechanism (16) independent of said actuation of said electrically-operated actuator (6) and said inside emergency release lever (5), said back-up mechanism including an outside emergency release lever (71) for engaging and moving said secondary pawl (27) to said auxiliary ratchet release position in response to rotation in a first direction thereby permitting movement of said ratchet (15) to release the striker (4) and an outside emergency lock lever (72) operatively coupled between said outside emergency release lever (71) and said auxiliary ratchet (26) for engaging and moving said auxiliary ratchet (26) to said enabling position in response to rotation of said outside emergency release lever (71) in a second direction opposite said first direction thereby maintaining said ratchet (15) in said at least one lock position to retain the striker (4);

characterized by further comprising an inhibiting lever (81) operatively coupled between said ratchet (15) and said back-up mechanism (7) for movement to a disabling condition preventing interaction of said back-up mechanism (7) with said auxiliary ratchet (26) in response to movement of said ratchet (15) towards said release position.

2. A latch as claimed in claim 1, wherein said inhibiting lever (81) is interposed between said ratchet (15) and said back-up mechanism (7).

3. A latch as claimed in claim 2, wherein said back-up mechanism (7) is manually operable by the user in the first direction (T1) for interacting with said secondary pawl (27) and in the second direction (T2), opposite to said first direction (T1), for interacting with said auxiliary ratchet (26).

4. A latch as claimed in claim 1, wherein said ratchet (15) comprises push means (84) for pushing said inhibiting lever (81) to said disabling position.

5. A latch as claimed in claim 4, wherein said ratchet (15) includes a partially locked position interposed between said release position and said at least one lock position, and wherein said ratchet (15) and said push means (84) are configured to interact with said inhibiting lever (81) in such a manner that, moving from said partially locked position to said release position, the ratchet (15) maintains the inhibiting lever (81) in said disabling condition.

6. A latch as claimed in claim 1, wherein said inhibiting lever (81) is biased by elastic means (85) into a free position, in which the inhibiting lever (81) cannot interact with said back-up mechanism (7).

7. A latch as claimed in claim 1, wherein said emergency release lever (71) comprises first transmission means (76) for interacting with said secondary pawl (27) in response to rotation in said first direction and second transmission means (79) for interacting with said emergency lock lever (72) in response to rotation in said second direction and moving the emergency lock lever (72) towards said auxiliary ratchet (26).

8. A latch as claimed in claim 7, wherein said second transmission means (79) comprise elastic means (77) carried by said emergency release lever (71) and configured for directly cooperating with said emergency lock lever (72).

9. A latch as claimed in claim 1, wherein said inhibiting lever (81) has an intermediate portion (81*a*) hinged about a fixed pin (28), a first arm (81*b*) adapted to receive a push action from said ratchet (15) when the ratchet (15) moves towards said release position, and a second arm (81*c*) having at least a portion (83) adapted to be interposed between said back-up mechanism (7) and said auxiliary ratchet (26) in said disabling condition of the inhibiting lever (81).

* * * * *